US006718932B1

(12) United States Patent
Cecur et al.

(10) Patent No.: US 6,718,932 B1
(45) Date of Patent: Apr. 13, 2004

(54) LIGHTWEIGHT ENGINE POPPET VALVE

(75) Inventors: Majo Cecur, Rivarolo Canavese (IT); Marco Querio, Castellamonte (IT); Sinharoy Shubhayu, Kalamazoo, MI (US); Sundaram L. Narasimhan, Marshall, MI (US); Jose F. Masello, Battle Creek, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/350,509

(22) Filed: Jan. 24, 2003

(51) Int. Cl.[7] ..... F02N 3/00
(52) U.S. Cl. ..... 123/188.3; 251/337; 29/888.46
(58) Field of Search ..... 123/188.3, 90.51; 251/337, 368; 29/888.46

(56) References Cited

U.S. PATENT DOCUMENTS

| | | | | |
|---|---|---|---|---|
| 4,597,367 | A | 7/1986 | Hayashi | 123/188 AA |
| 4,834,036 | A | 5/1989 | Nishiyama et al. | 123/188 A |
| 5,370,092 | A | 12/1994 | Shimizu et al. | 123/188.3 |
| 5,413,073 | A | 5/1995 | Larson et al. | 123/188.3 |
| 5,441,235 | A | 8/1995 | Narasimhan et al. | 251/368 |
| 5,458,314 | A | 10/1995 | Bonesteel | 251/337 |
| 5,517,956 | A | 5/1996 | Jette et al. | 123/188.3 |
| 5,553,369 | A | 9/1996 | Shimizu et al. | 29/888.46 |
| 5,823,158 | A | 10/1998 | Heimann, Jr. et al. | 123/188.3 |
| 6,006,713 | A | 12/1999 | Gebauer | 123/188.3 |
| 6,263,849 | B1 | 7/2001 | Bonesteel et al. | 123/90.51 |

*Primary Examiner*—Andrew M. Dolinar
*Assistant Examiner*—Katrina B. Harris
(74) *Attorney, Agent, or Firm*—Daniel S. Kalka; L. J. Kasper

(57) ABSTRACT

A lightweight engine poppet valve that has a valve head portion made from a lightweight, heat resistant material is attached to a hollow tube stem portion. The attachment is made with a mechanically locking interfitting joint on an extending portion of the valve head at a preselected distance. Preferably, the mechanically locking interfitting joint is a hydroformed joint.

20 Claims, 6 Drawing Sheets

LIGHTWEIGHT ENGINE POPPET VALVE

BACKGROUND OF THE INVENTION

1. Field of the Invention

The present invention relates generally to a poppet valve for an internal combustion engine, and more particularly to a lightweight engine poppet valve constructed with a mechanically locking interfitting joint connecting the valve head to the valve stem capable of operating at high temperatures and in a corrosive environment.

2. Description of the Related Art

It is well known in the industry that engine poppet valves operate at relatively high temperatures and in corrosive environments. It is further known that exhaust valves operate under more severe conditions than intake valves. The exhaust valves used in diesel and leaded fuel applications, which are considered heavy duty applications, operate in more severe conditions than in other types of internal combustion engines. Engine poppet valves must be able to withstand even the most severe of these conditions and still be durable.

Efforts are constantly being made to improve the construction, design, and manufacturing techniques of engine poppet valves. These efforts include, but are not limited to, making the valve lighter in weight, more economical to manufacture, and more durable. Lighter poppet valves can offer better fuel economy for a vehicle due to weight considerations, and can be manufactured more cost effectively due to less material employed in the valve. In addition, engine poppet valves can be designed with specific chemical and mechanical properties in mind to withstand the harsh temperature and environmental conditions to which engine poppet valves are subjected. Some of these desired chemical and mechanical properties include, but are not limited to, excellent sulfidation resistance, good hot hardness, sufficient oxidation resistance, optimum thermal resistance, and low thermal expansion.

The term "lightweight" as employed herein is intended to refer to the physical characteristics of the engine poppet valve and its components that make the engine poppet valve light in weight. The term "lightweight" is also meant to include but not be limited to an ultralight engine poppet valve as that term is defined in U.S. Pat. No. 5,413,073 which is owned by the assignee of the present invention and is hereby incorporated by reference. The assignee of the present invention also owns U.S. Pat. Nos. 5,453,314 and 6,263,849, which are both hereby incorporated by reference.

There is still a desire to make improvements in the manufacturing technique and design of a lightweight engine poppet valve. The engine poppet valve would be constructed in an arrangement that mechanically attaches the valve head to the hollow stem portion in a locking arrangement. Even with this mechanically locking attachment being located in the high temperature and corrosive combustion zone, the lightweight poppet valve would provide excellent sulfidation resistance, good hot hardness, good oxidation resistance, and optimum thermal conductivity with low thermal expansion, optimum thermal resistance, and durability.

BRIEF SUMMARY OF THE INVENTION

Accordingly, an object of the present invention is to provide an improved lightweight engine poppet valve constructed in a manner that mechanically attaches the valve head to the stem portion in a locking arrangement with an interfitting joint.

Another object of the present invention is to provide such an engine poppet valve with a valve head made from a titanium intermetallic material that is lightweight, and is durable at optimum temperatures.

Still another object of the present invention is to provide an engine poppet valve manufactured with a valve head attached to a stem portion by means of a compressed interfitting joint.

Still another object of the present invention is to provide an improved method for making a lightweight engine poppet valve that mechanically attaches the valve head to the stem portion in a locking arrangement with an interfitting joint.

These and other objects of the present invention are accomplished with an engine poppet valve comprising a valve head portion, a stem portion, a tip portion and a flared fillet portion of the valve head portion. The flared fillet portion defines a transition region between the valve head portion and the stem portion, and includes an extending portion constructed to form a mechanically locking interfitting joint with the valve stem portion. The valve head portion is made from a lightweight, heat resistant, thermally conductive material.

Another aspect of the present invention is a method for making an engine poppet valve comprising the steps of forming a valve head from a titanium intermetallic material, providing the valve head with a fillet having an extending portion with a preselected length; providing a tubular stem portion, positioning the extending portion of the valve head inside one end of the tubular stem portion; and compressing the tubular stem portion around the extending portion of the valve head for forming a mechanically locking interfitting joint between the extending portion of the valve head and the tubular stem portion.

Still another aspect of the present invention is directed to a method for making an engine poppet valve having a valve head that is durable at high temperatures and thermal resistant, and a deep drawn valve stem portion attached to an extending portion of the valve head with a hydroformed interfitting joint which mechanically attaches and locks the valve head to the stem portion.

The various features of novelty which characterize the invention are pointed out with particularity in the claims annexed to and forming a part of this disclosure. For a better understanding of the invention, its operating advantages, and specific objects attained by its uses, reference is made to the accompanying drawings and descriptive matter in which a preferred embodiment of the invention is illustrated.

DETAILED DESCRIPTION OF THE INVENTION

Figure 1:
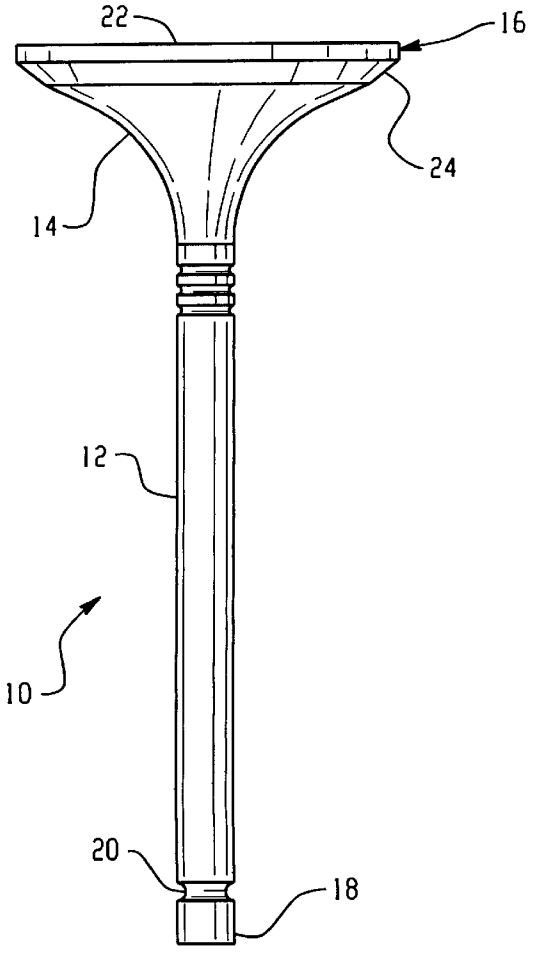
FIG. 1 is an elevated perspective view of an engine poppet valve in accordance with the present invention.

The Figures are not intended to limit the present invention thereto, and like numerals designate like or similar features throughout the several views. FIG. 1 shows an engine poppet valve, generally designated 10, in accordance with the present invention. Poppet valve 10 includes a hollow stem portion 12 and a fillet portion 14 defining a transition region to a valve head portion generally designated 16. The fillet 14 tapers concavely inwardly to connect the valve head 16 to the stem 12. Stem 12 terminates in a tip portion 18. The tip portion 18 includes one or more keeper grooves 20 provided to accommodate a retainer for a valve spring as depicted in FIG. 2.

The present invention resides in the engine poppet valve 10 being constructed in a manner that mechanically attaches and locks the valve head 16 to the stem portion 12 to form what is referred to herein as a "mechanically locking interfitting joint". The term "mechanically locking interfitting joint" as used herein is intended to mean a mechanical attachment between two components which simultaneously is a locking attachment that will not allow the two components to be readily disassembled and then re-assembled as for example in a threaded arrangement. The mechanically locking interfitting joint is described in much greater detail later herein and attention will be first directed to the basic structure of an engine poppet valve and its operation.

Figure 2:
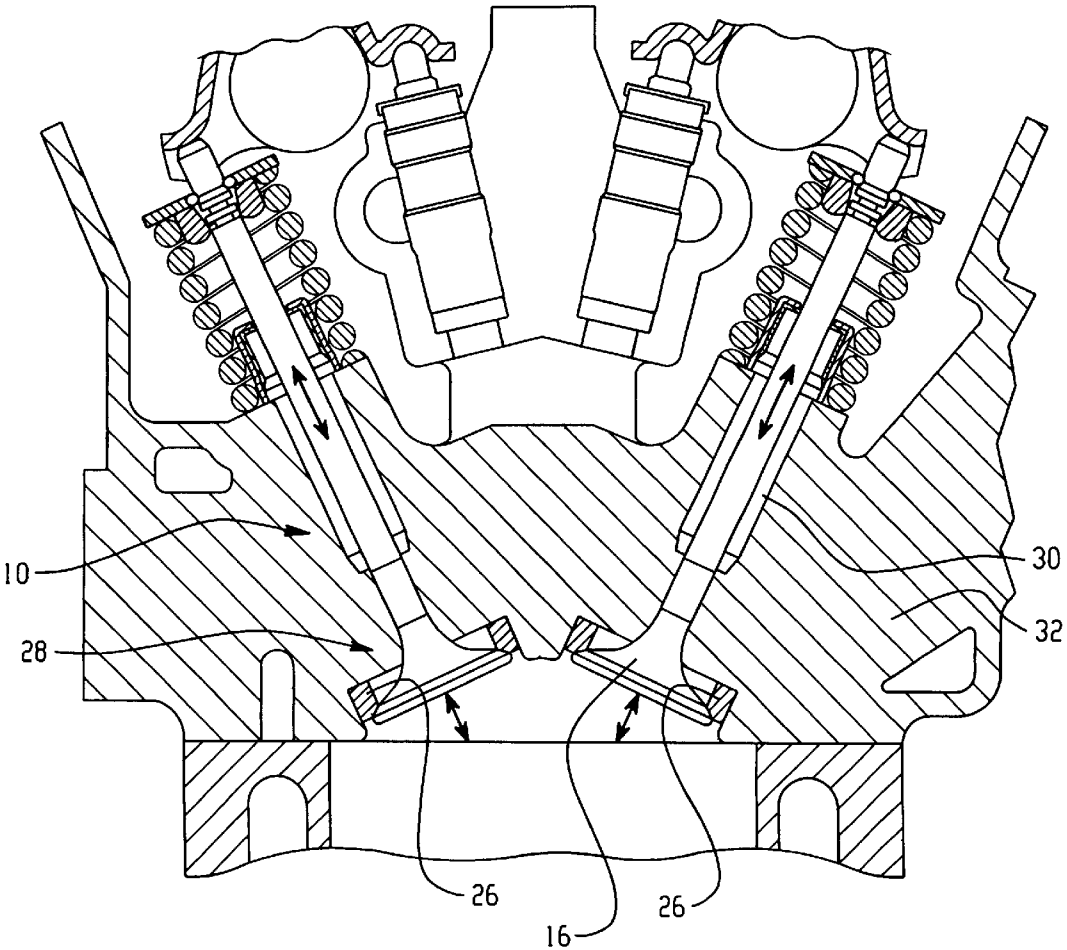
FIG. 2 is a sectional view illustrating a valve assembly and its associated environment.

The valve head 16 includes a combustion face 22 that faces inwardly into an engine combustion chamber and a valve seat face 24 which is the peripheral surface that engages the engine block or a valve seat insert 26 as seen in FIG. 2. The valve head 16 is manufactured with a predetermined diameter that depends upon the given internal combustion engine application. While it is known in this art that an engine poppet valve can be solid, hollow, or partially solid/hollow, the present invention is directed particularly to hollow or partially solid/hollow valves as will be described in further detail herein, to take advantage of unique material properties involved to achieve an optimum light weight valve.

Still referring to FIG. 2 and for purposes of basic background on the operation of an engine poppet valve, there is shown the engine poppet valve 10 as part of a valve assembly 28 for use in an internal combustion engine. The engine poppet valve 10 is reciprocally received within the internal bore of a valve stem guide 30. While the valve stem guide 30 is depicted as a tubular structure which is inserted into the cylinder head 32 of the engine, it should be understood that alternative embodiments include the cylinder head itself functioning as a guide for the valve stem 12 without a separate tubular structure serving as the valve stem guide. The valve seat insert 26 cooperatively receives the valve seat face 24 to provide a sealing engagement. Since the operation of a poppet valve and a valve assembly within an internal combustion engine are well known in this art, further description and details concerning its operation are not included herein for the sake of brevity.

Figure 3:
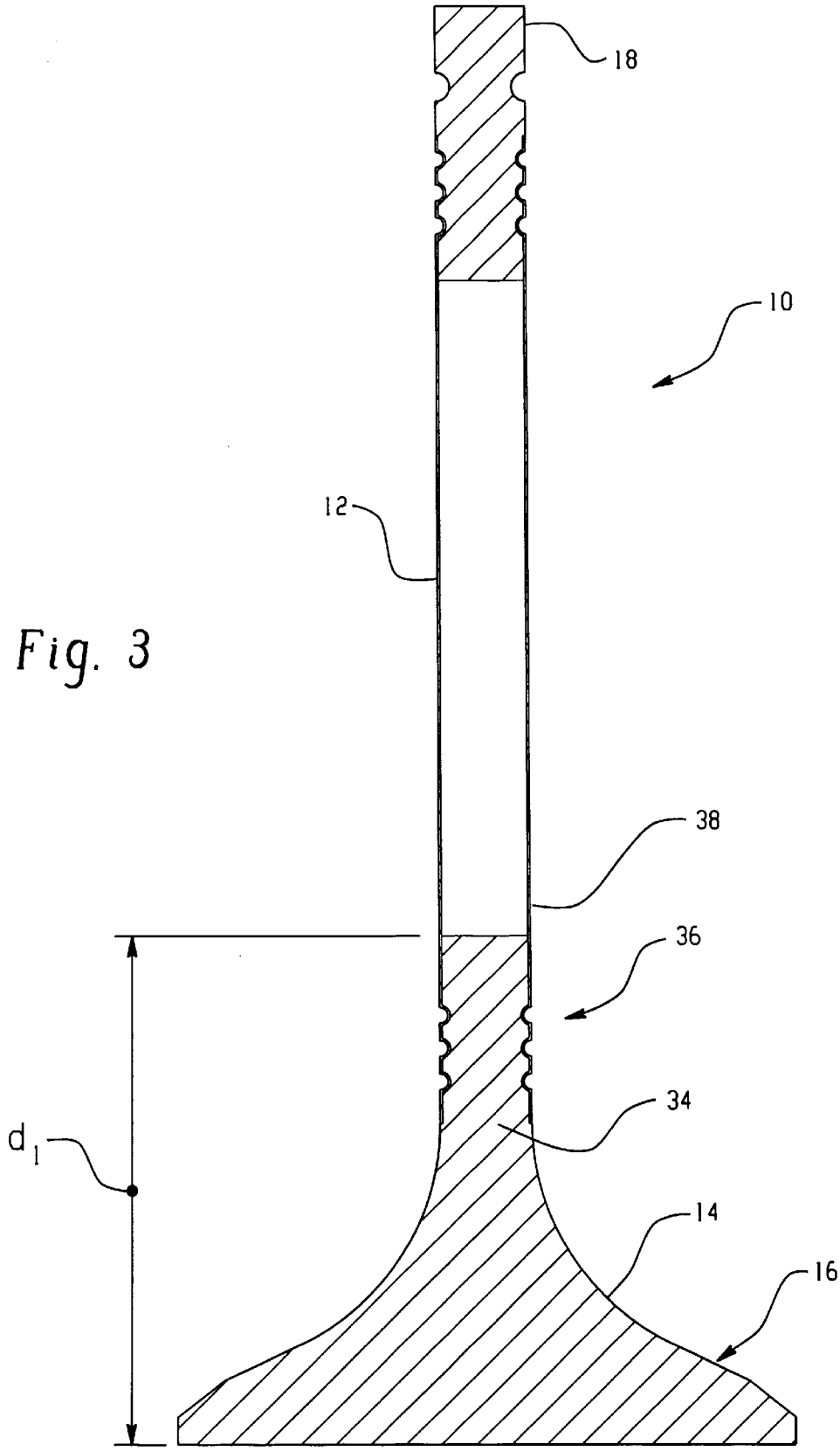
FIG. 3 is a sectional view of a lightweight engine poppet valve according to a first embodiment of the present invention.

FIG. 3 depicts a sectional view of the assembled engine poppet valve 10 according to a first embodiment of the present invention. The valve head 16 is integrally formed via a ceramic forming process, casting process or powder metallurgy with the valve fillet portion 14. An extending portion 34 that extends a predetermined distance (d1) from the valve head, is constructed for an interfitting joint 36 at one end 38 of the valve stem portion 12. The fillet portion 14 preferably includes a shoulder 39 shown in FIG. 8 positioned so the valve stem portion 12 abuts the fillet portion 14 so that their respective surfaces form a continuous surface as shown in FIG. 1. The opposite end of the valve stem portion 12 has the tip portion 18 attached thereto or deep drawn therewith in a manner as is known in this art for attaching valve stem tips.

Figure 5:
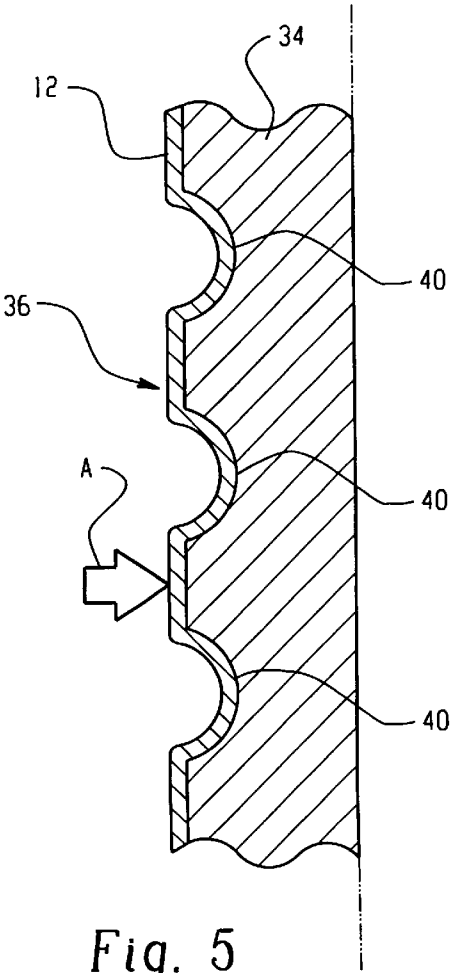
FIG. 5 is a fragmentary sectional view similar to FIG. 4 but depicts the interfitting joint after it is formed.
Figure 4:
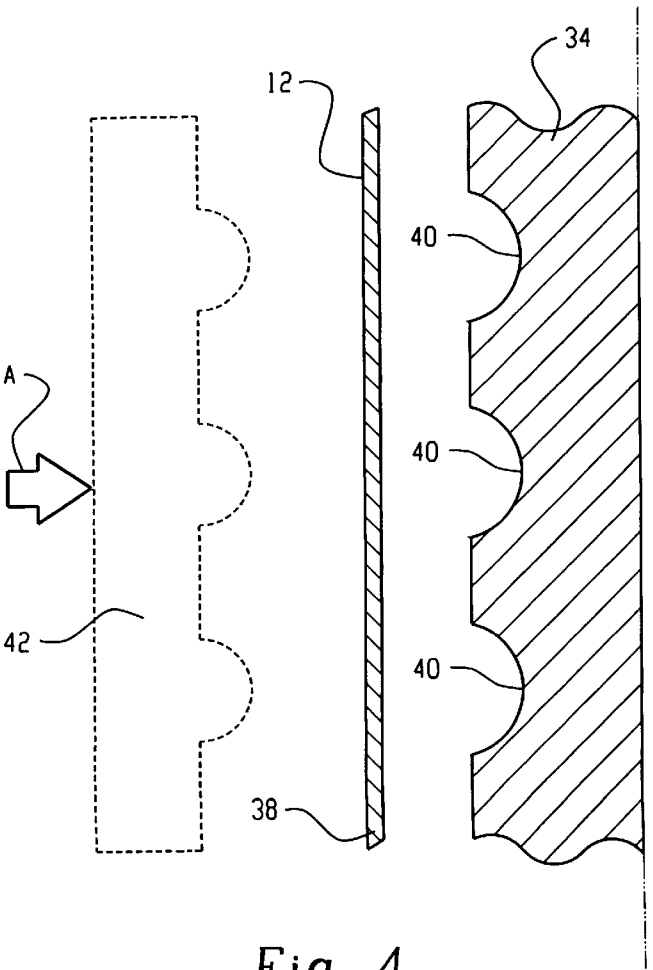
FIG. 4 is a fragmentary sectional view depicting a portion of the valve stem and the extending portion of the valve head prior to forming the interfitting joint.

FIG. 4 is a fragmentary sectional view of the extending portion 34 of valve head 16 slidably received within end 38 of the valve stem portion 12 prior to forming the interfitting joint 36. Extending portion 34 of the valve head 16 is sized to fit within end 38 of valve stem portion 12 in a close fitting relationship. Extending portion 34 further includes at least one groove 40, preferably a plurality of grooves 40, and more preferably two grooves 40 axially spaced along its length at the desired location or locations for the interfitting joint 36. A force as depicted by arrow A or any suitable tool or device shown in dashed lines and designated 42 in FIG. 4 is employed to provide a uniform compressive or crimping radial force to crimp or compress the end 38 of the valve stem portion 12 against the extending portion 34. The force from arrow A or tool 42 is sufficiently strong to force the walls of the valve stem portion 12 into grooves 40 on the extending portion 34 as depicted in FIG. 5 to create the interfitting joint 36 that mechanically attaches and locks the valve head 16 to the valve stem portion 12. The groove 40 preferably has a contour radius that allows the material of valve stem portion 12 to conform to the groove 40 after compression. The contour radius of the groove is a function of the wall thickness of the tube and its material proprieties. FIG. 5 shows the mechanically attached interfitting joint 36 after it is formed. The interfitting joint 36 mechanically locks the valve head 16 to the valve stem portion 12. The preferred method for mechanically making this locking interfitting joint 36 is by means of hydroforming as will be described in further detail later herein.

As is seen in FIGS. 1 and 3, the interfitting joint 36 is disposed relatively close to the valve head 16 and as such joint 36 is exposed with the reciprocating action of the engine poppet valve to the high temperatures and corrosive conditions in the combustion chamber. Still, the interfitting joint 36 according to the first embodiment of the present invention is sufficiently strong to withstand the high temperatures and corrosive conditions. High temperature fatigue tests conducted at about 1200° F. and at about 45% of the ultimate tensile strength (UTS) of the joint at a load of 2.42 KN (KiloNewtons) yielded about $10^7$ cycles with the test being suspended but not due to failure. When the load was increased to about 3.00 KN, the test ran about 6,861,322 cycles to failure. When the load was increased even further to about 3.24 KN, the test ran about 3,925,624 cycles to failure. A final test with a load at about 3.78 KN yielded about 229,477 cycles to failure.

Figure 6:
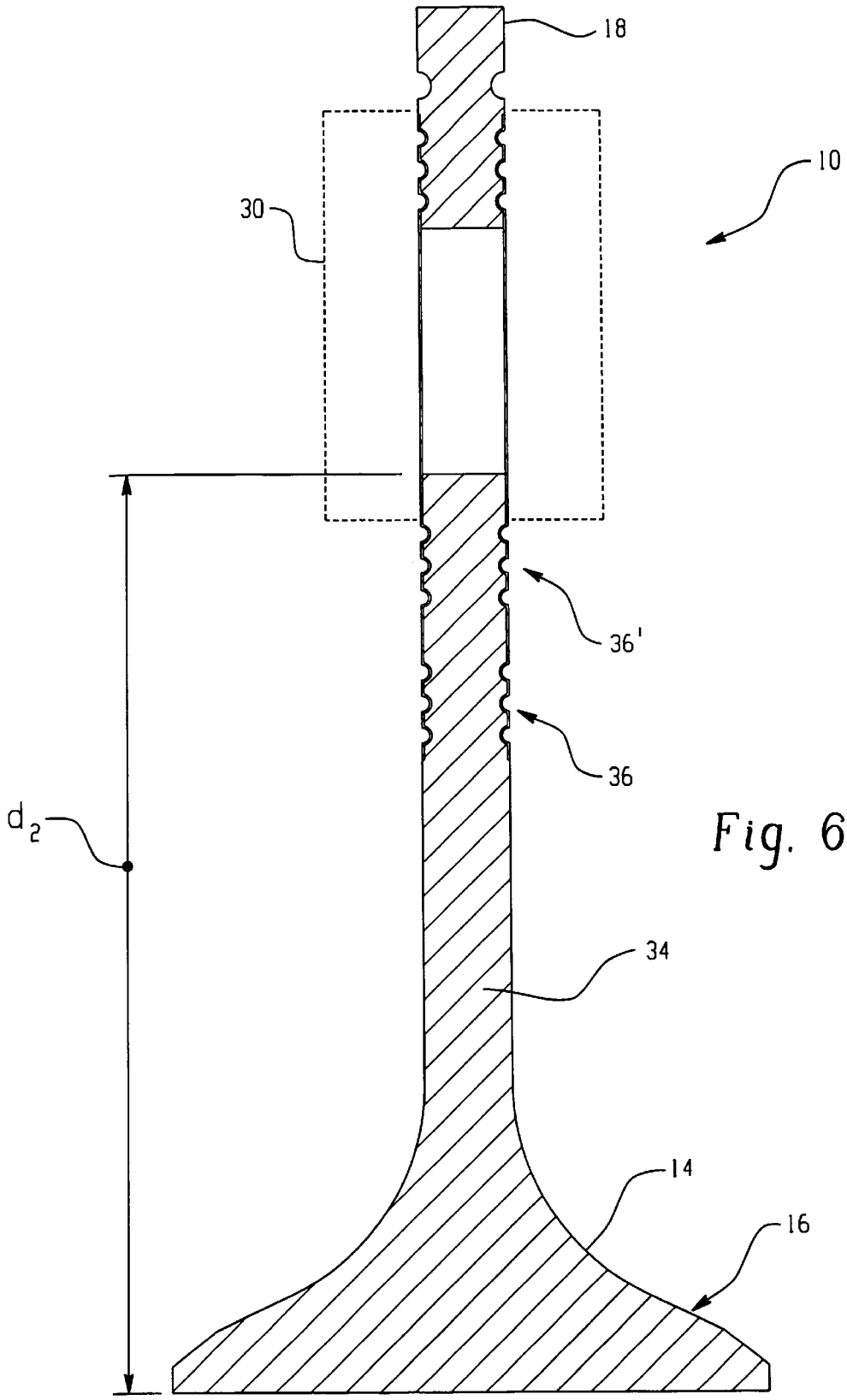
FIG. 6 is a sectional view of another embodiment of the engine poppet valve according to the present invention.

Referring now to FIG. 6, there is shown another embodiment of the present invention in sectional view where the extending portion 34 extends a distance or length d2 from the valve head. This embodiment preferably uses two or more joints 36, 36'. Extending portion 34 may be varied to position the interfitting joint 36' at any given distance away from the valve head 16. As seen in FIG. 6, the interfitting joint 36' may be positioned approximately at the bottom of the valve guide 30 which is shown in dashed lines. Or, the interfitting joint 36' may be positioned within the valve guide 30. A longer extending portion 34 may be desirable in some applications for transferring heat generated by combustion away from the valve 10 through the valve guide 30 for dissipation into the cylinder block 32.

The various sizes and lengths of engine poppet valves are dependent upon the given engine application, but it should be readily apparent that a wide variety of thermal and mechanical properties are achievable with the selection of different lengths (d1 or d2) for the extending portion 34 of the valve head 16. For illustrative purposes only, a poppet valve having a total length of about 12.5 centimeters may have one interfitting joint 36' situated at a distance of about 6.5 cm from the valve head and an interfitting joint 36 located at about 2.5 cm. In this example, interfitting joint 36' employs two grooves 40 while interfitting joint 36 employs only one groove 40. Another example of a poppet valve having a total length of about 12.5 cm. may have a single interfitting joint 36 located 3.5 cm from the valve head. It should be understood that the present invention is not intended to be limited to these examples.

Advantageously, the present invention employs preferably a solid valve head 16 and extending portion 34 made of preferably a titanium intermetallic material or compound. As employed herein, the term "titanium intermetallic material" is meant to include but not be limited to the following materials, titanium alloys, titanium boride, titanium aluminide, and titanium. The titanium aluminide material is commercially available and preferably comprises titanium with approximately 30 to 50 weight percent aluminum. More preferably, the aluminum content ranges from about 32% to about 35% with small amounts of iron and oxygen. The titanium intermetallic material offers a high strength-to-weight ratio as well as excellent sulfidation resistance, good hot hardness, sufficient oxidation resistance, high thermal conductivity and lower thermal expansion. As is known in the art of casting metals and their alloys, the shorter casting time for titanium aluminide significantly reduces shrinkage porosity. As a result, one can produce more castings per mold for a significant increase in productivity. The good thermal conductivity of a titanium aluminide valve head allows the valve to operate without coolant in the hollow stem. If desirable for a particular application, coolant may be added to the valve stem 12. Additionally, valve head 16, while shown as a solid valve head, may be hollowed out to various degrees and depths, and still be in accordance with the present invention.

After casting, the TiAl valve head castings were subjected to hot isostatic pressing (HIP). HIP is a process known in this art and is used to remove centerline shrinkage and close internal porosity.

Other materials that are suitable for the present invention include without limitation superalloys, preferably cast, and other intermetallics, like NiAl. Ceramic materials are suitable for the present invention, and include without limitation silicon carbide, silicon nitride, boron nitride, or other suitable oxides or nitrides.

Ceramics and titanium aluminde are brittle materials. Advantageously, the preferred hydroforming process utilizes hydrostatic fluid pressure to apply a uniform compressive radial force to make a locking interfitting joint 36, 36'. The process according to the present invention can be used for materials which exhibit brittle behavior typically characterized by ductility levels less than about 2% to about 4% tensile elongation.

The valve stem portion 12 may be a hollow tube or preferably a deep drawn valve stem made from a wide assortment of materials including but not limited to a titanium alloy such as a titanium aluminide, a stainless steel material such as a 305 or 304 stainless steel that may be machined or deep drawn, a martensitic stainless steel material, or a nickel-based alloy. In addition, the valve stem portion 12 may be coated with a coating that includes, but is not limited to, chromium plated coating, molybdenum sprayed coating, an Eatonite coating, physical vapor deposition (PVD or chemical vapor deposition (CVD) type coatings or a nitride coating.

The tip portion 18 preferably is a solid, hardened material such as SAE 1547 or 8645 or Silchrome-1 Steel (Society of Automotive Engineers (SAE) J775 standard) material which is commercially available from commercial suppliers like Charter Steel or Crucible Steel for example. Alternatively, the tip portion 18 may be simply a conventional hardened steel material. The tip portion 18 may be attached to the stem portion 12 in any manner known in the art.

Figure 7:
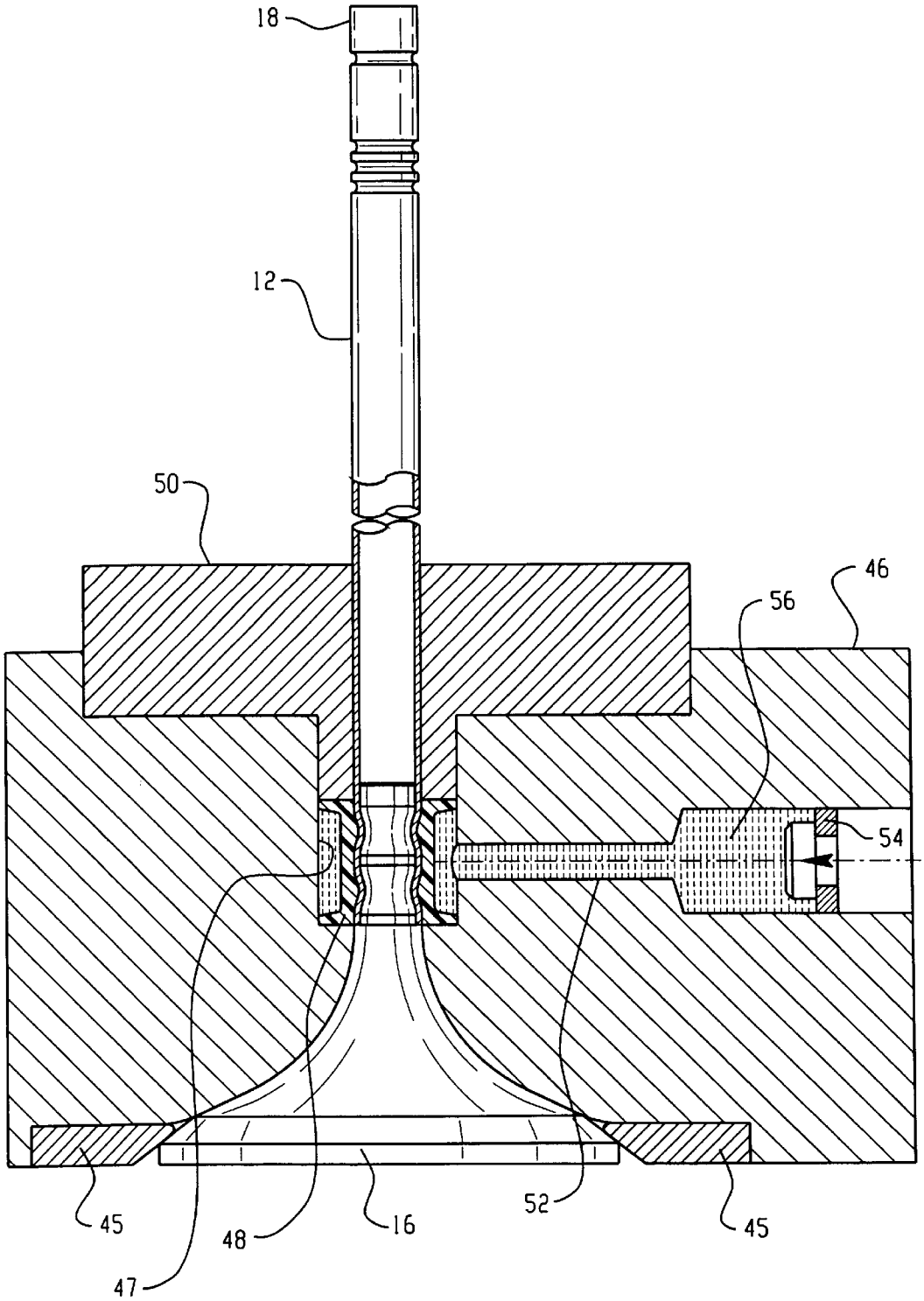
FIG. 7 is a sectional view of the engine poppet valve within the hydroforming die according to the present invention.

Another aspect of the present invention is directed to a method for making a lightweight engine poppet valve constructed in an arrangement that mechanically attaches and locks the valve head 16 to the valve stem 12. The extending portion 34 of the valve head 16 is fastened to the valve stem 12 with a mechanically locking interfitting joint 36, 36'. Referring next to FIG. 7, there is shown in sectional view an apparatus preferably employed to mechanically attach and lock the valve head portion 16 to the valve stem portion 12. The preferred method of compressing or uniformly crimping the valve stem portion 12 is using a hydroforming process. While FIG. 7 depicts one such device, it is to be understood that the principles of the present invention are applicable to other devices that can uniformly compress valve stem portion 12 in a manner that provides a uniform compressive radial force to form the mechanically locking interfitting joint 36, 36' as described and shown herein.

Valve head portion 16 is secured within the jaws 45 of die 46 to firmly hold the valve head portion 16 therein. The valve stem portion 12 is fitted over the extending portion 34 of valve head portion 16 and is positioned within a pressurization chamber 47 in the die. The pressurization chamber 47 is sealed within die 46 with a retaining die member 50 and o-rings (not shown), or any suitable high pressure sealing means. The preferred method employs a deformable spool member 48 positioned coaxially over the valve stem portion 12 and over the extending portion 34 at the desired location of the interfitting joint 36 within the pressurization chamber 47. The retaining die member 50 positioned over the valve stem portion 12 secures the valve stem 12 and the spool member 48 in place within the die 46. The retaining die member 50 is securely fastened to the die 46 by way of clamps (not shown), or other suitable means.

Die 46 includes a channel 52 which fluidly communicates with the pressurization chamber 47 and the deformable spool member 48 in the selected location for the interfitting joint 36, 36'. A high fluid pressure system 54, such as a high pressure pump, forces a fluid 56, preferably oil like a hydraulic or motor oil, under a pressure ranging from about 1850 to about 2200 $Kg/mm^2$, preferably about 3 Bar for a TiAl valve, to deform spool member 48 which uniformly compresses the end 38 of the valve stem portion 12 for attaching the extending portion 34 thereto and forms the hydroformed interfitting joint 36, 36'.

Figure 8:
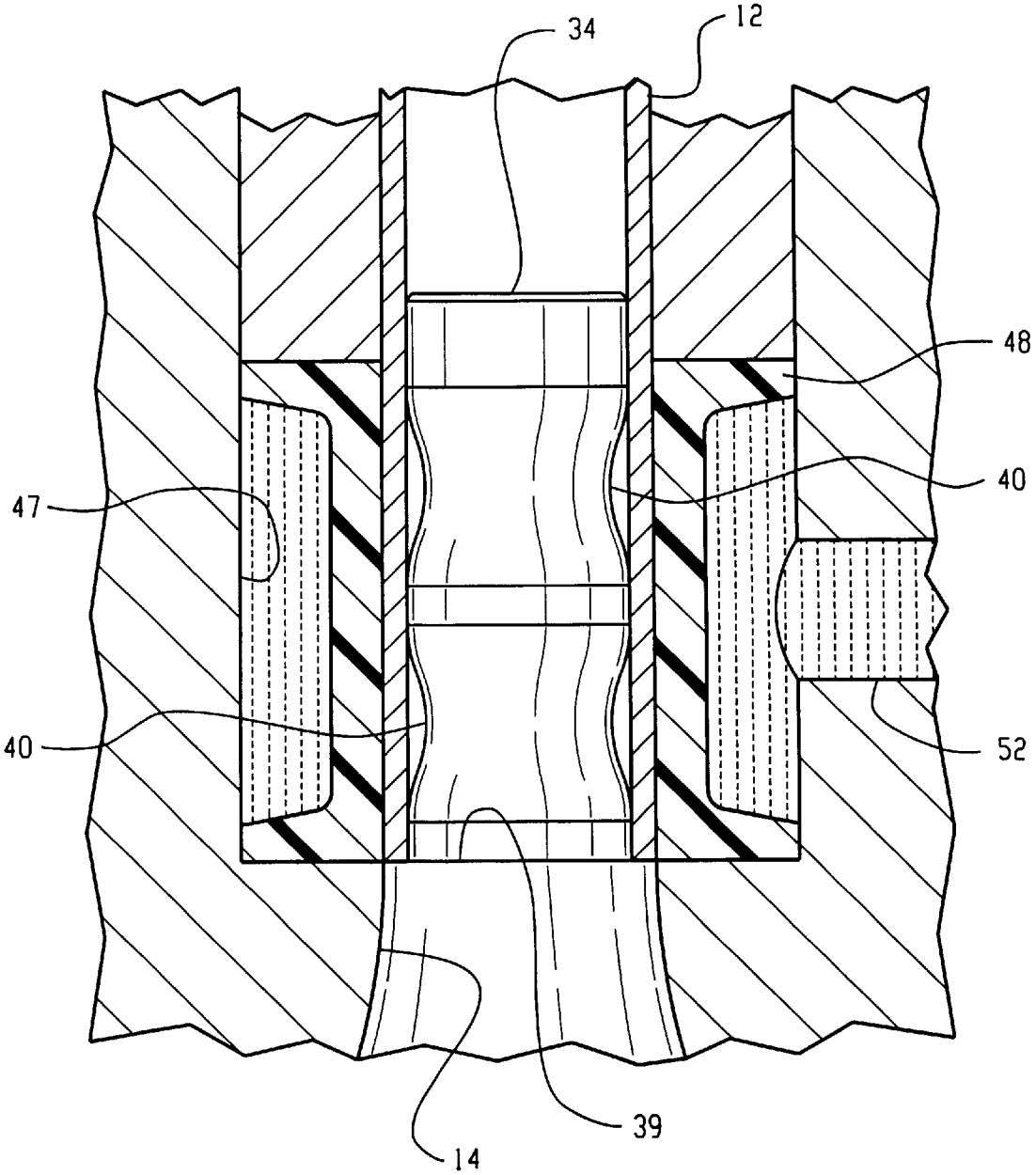
FIG. 8 is an enlarged fragmentary sectional view of the hydroforming die and spool member according to the present invention.

FIG. 8 is an enlarged sectional view of the pressurization chamber 47 and spool member 48. The extending portion 34 of valve head 16 as noted previously includes a plurality of grooves 40, and is sized to fit within valve stem portion 12. Shoulder 39 on the fillet portion14 provides a surface that conforms with the surface of the valve stem portion 12.

The deformable spool member 48 is preferably made of a polymer material, in particular a high strength elastomer capable of withstanding high pressures and sufficiently resilient to return substantially to its initial form after the hydroforming process, for example, a polytetrafluoroethylene (PTFE) material like Teflon®, a registered trademark of E.I. DuPont de Nemours, Adiprene®, a registered trademark of Uniroyal Chemical Co., Inc. or Curalon M, a trademark of Ihara Chemical Industry, Co. Other high temperature sealing materials such as graphite, blends of polymers and graphite, or the like may also be suitable.

If desired for further strengthening, the edge of the interfitting joint 36 that meets the valve head portion 16 and/or the uniformly crimped areas caused by the grooves 40 may be filled in with brazing or welding. The assembly is then finish machined and the stem is coated, for example, by a molybdenum sprayed coating as mentioned earlier.

In the above manner, the present invention provides a lightweight valve made with components that can be assembled rapidly with the use of a mechanically locking interfitting joint. This makes the lightweight valve more economical to manufacture and still provides good durability. The use of the titanium aluminide head yields excellent sulfidation resistance, good hot hardness, sufficient oxidation resistance, and high thermal conductivity along with lower thermal expansion.

While specific embodiments of the invention have been shown and described in detail to illustrate the application of the principles of the invention, it will be understood that the invention may be embodied otherwise without departing from such principles.

We claim:

1. An engine poppet valve comprising a valve head portion, a stem portion, a tip portion, and a flared fillet portion of said valve head portion defining a transition region between said valve head portion and said stem portion, said flared fillet portion of said valve head portion including an extending portion, said valve head portion being a substantially lightweight, heat resistant material, said stem portion being a hollow tube constructed for a mechanically locking interfitting joint with said extending portion of said flared fillet portion.

2. An engine poppet valve as recited in claim 1, wherein said extending portion extends a selected distance from said flared fillet portion.

3. An engine poppet valve as recited in claim 2, wherein said mechanically locking interfitting joint comprises a hydroformed joint.

4. An engine poppet valve as recited in claim 1, wherein said valve head portion comprises a material being a member selected from the group consisting of a titanium alloy, titanium borides, titanium-aluminides, a titanium material, superalloys, intermetallics, and ceramics.

5. An engine poppet valve as recited in claim 2, wherein said mechanically locking interfitting joint is disposed proximate said valve head portion.

6. An engine poppet valve as recited in claim 2, wherein said mechanically locking interfitting joint is disposed in a valve guide of the cylinder head.

7. An engine poppet valve as recited in claim 2, wherein said mechanically locking interfitting joint is disposed at a location proximate a valve guide.

8. An engine poppet valve as recited in claim 2, wherein said fillet portion further comprises a shoulder constructed for an abutting relationship with an end of said stem portion.

9. An engine poppet valve as recited in claim 1, wherein said stem portion comprises a material being a member selected from the group consisting of a stainless steel material, an aluminum material, a machined or deep drawn 304 or 305 stainless steel material, a titanium-aluminide material, a titanium alloy, a machined or deep drawn martensitic stainless steel material, and a nickel-base alloy.

10. An engine poppet valve as recited in claim 9, wherein said stem portion further comprises a coating being a member selected from the group consisting of a chromium plated coating, molybdenum spray coating, an Eatonite coating, a PVD type coating, CVD type coating, and a nitrided coating.

11. An engine poppet valve, comprising:

a valve head made of an intermetallic compound, said valve head having a fillet portion with an extending portion having a preselected length; and a valve stem, said valve stem being a hollow tube and having one end constructed to slidably receive the extending portion of said valve head and be mechanically locked thereto with an interfitting joint, said valve stem further having a tip portion at an opposite end from said valve head.

12. An engine poppet valve as recited in claim 11, wherein said stem portion comprises a material being a member selected from the group consisting of a stainless steel material, an aluminum material, a machined or deep drawn 304 or 305 stainless steel material, a titanium-aluminide material, a titanium alloy, a machined or deep drawn martensitic stainless steel material, and a nickel-base alloy.

13. An engine poppet valve as recited in claim 12, wherein said valve stem is mechanically locked to said valve head with a hydroformed interfitting joint.

14. An engine poppet valve as recited in claim 13, wherein said extending portion of said valve head further comprises a plurality of grooves axially spaced thereon for forming said mechanically locking interfitting joint.

15. A method for making a lightweight engine poppet valve, comprising the steps of:

forming a valve head from an intermetallic material;

providing the valve head with a fillet having an extending portion with a preselected length;

providing a tubular stem portion;

positioning the extending portion of the valve head inside one end of the tubular stem portion; and compressing the tubular stem portion around the extending portion of the valve head for forming a mechanically locking interfitting joint between the extending portion of the valve head and the tubular stem portion.

16. A method according to claim 15, wherein the positioning step further comprises the steps of:

disposing the valve head and tubular stem portion in a die;

positioning a spool member within the die coaxially surrounding the end of the tubular stem portion positioned around the extending portion of the valve head; and supplying fluid under pressure against the spool member to hydraulically compress the tubular stem portion around the extending portion of the valve head portion.

17. A method according to claim 15, wherein the step of the providing the valve head further comprises the step of:

providing a plurality of grooves in the extending portion.

18. A method according to claim 15, wherein the step of providing the tubular stem portion further includes the step of coating the tubular stem portion with a material being a member selected from the group consisting of a chromium plated coating, a molybdenum spray coating, an Eatonite coating and a nitride coating.

19. A method according to claim 16, wherein the spool member comprises a deformable polymer material.

20. A method according to claim 18, wherein the step of coating further includes the step of coating a valve seat.

* * * * *